US011371274B2

(12) United States Patent
Li et al.

(10) Patent No.: US 11,371,274 B2
(45) Date of Patent: Jun. 28, 2022

(54) PUSH-PULL DOOR/WINDOW

(71) Applicant: Shenzhen Hopo Window Control Technology Co. Ltd., Guangdong (CN)

(72) Inventors: Shupeng Li, Guangdong (CN); Xiaojuan Tan, Guangdong (CN); Ping He, Guangdong (CN); Zhou Lin, Guangdong (CN)

(73) Assignee: Shenzhen Hopo Window Control Technology Co., Ltd., Guangdong (CN)

( * ) Notice: Subject to any disclaimer, the term of this patent is extended or adjusted under 35 U.S.C. 154(b) by 464 days.

(21) Appl. No.: 16/337,045

(22) PCT Filed: Aug. 10, 2017

(86) PCT No.: PCT/CN2017/096810

§ 371 (c)(1),
(2) Date: Mar. 27, 2019

(87) PCT Pub. No.: WO2019/010742

PCT Pub. Date: Jan. 17, 2019

(65) Prior Publication Data

US 2020/0032567 A1 Jan. 30, 2020

(30) Foreign Application Priority Data

Jul. 14, 2017 (CN) ..... 201710575492.0

(51) Int. Cl.
*E05D 15/10* (2006.01)

(52) U.S. Cl.
CPC .. *E05D 15/1042* (2013.01); *E05D 2015/1049* (2013.01); *E05Y 2900/132* (2013.01); *E05Y 2900/148* (2013.01)

(58) Field of Classification Search
CPC ..... E05D 2015/1049; E06B 3/4627; E06B 3/4645
See application file for complete search history.

(56) References Cited

U.S. PATENT DOCUMENTS 909,602 A * 1/1909 Hussey ..... 49/217
2,740,168 A * 4/1956 Wright ..... B64C 1/14 49/217

(Continued)

FOREIGN PATENT DOCUMENTS

CN 102852432 A 1/2013
CN 107165522 A 9/2017

(Continued)

OTHER PUBLICATIONS

International Search Report for corresponding PCT Application No. PCT/CN2017/096810 dated Apr. 18, 2018.

*Primary Examiner* — Catherine A Kelly
(74) *Attorney, Agent, or Firm* — Wood, Phillips, Katz, Clark & Mortimer

(57) ABSTRACT

Disclosed is a sliding door or window. The sliding door or window includes a door/window frame, a swing fastening mechanism is disposed at a lower end of a side of the door/window frame, and a locking structure is mounted on an upper end of the side of the door/window frame. The swing fastening mechanism and the locking structure are each provided with a snakelike groove inside which a shaft operative to slide along a groove orientation is arranged. A handle disposed on the door/window frame is operative to drive the shaft to slide in the snakelike groove, thereby forcing the swing fastening mechanism or/and the locking structure to swing.

19 Claims, 20 Drawing Sheets

(56) References Cited

U.S. PATENT DOCUMENTS

| | | | | |
|---|---|---|---|---|
| 6,442,900 | B1 * | 9/2002 | Kvasnes | E05D 15/1042 49/409 |
| 2007/0000179 | A1 * | 1/2007 | Krohn | E06B 3/4645 49/449 |
| 2019/0292828 | A1 * | 9/2019 | Liu | E05C 9/063 |

FOREIGN PATENT DOCUMENTS

| | | | | |
|---|---|---|---|---|
| CN | 207080075 | U | 3/2018 | |
| EP | 0027261 | A1 * | 4/1981 | E05D 15/581 |
| EP | 0816616 | A2 * | 1/1998 | E05D 15/1042 |
| EP | 1178174 | A2 * | 2/2002 | E05D 15/1042 |
| GB | 387931 | A | 7/1932 | |
| WO | WO-9318261 | A1 * | 9/1993 | E05D 15/1042 |
| WO | WO-2015082325 | A1 * | 6/2015 | E05D 15/10 |

* cited by examiner

PUSH-PULL DOOR/WINDOW

CROSS REFERENCE TO RELATED APPLICATIONS

This is a National Stage Application, filed under 35 U.S.C. 371, of International Patent Application No. PCT/CN2017/096810, filed on Aug. 10, 2017, which claims priority to Chinese patent application No. 201710575492.0, filed on Jul. 14, 2017, disclosures of which are incorporated herein by reference in their entireties.

TECHNICAL FIELD

The present disclosure relates to the technical field of door and window manufacturing, and more particularly relates to a sliding door or window provided with a swing supporting mechanism.

BACKGROUND

Sliding doors or windows have been widely used, such as a sliding door mounted between a kitchen and a living room in home, a partition door in an office, a balcony door, a factory window, a home window, and so on. A sliding door or window mainly includes a door or window body. In a better product, a pulley is arranged under the door or window body to operate in cooperation with a guide rail disposed on the door or window, thereby making opening the door/window be a labor-saving and convenient operation. Such form of product has many advantages over the traditional door or window products. Nevertheless, there exists a big drawback in that a certain amount of leeway may be present between the door/window and the frame or between the pulley and the guide rail, such that a crashing sound may occur when a strong wind is blowing or an external force is colliding to the door/window. Moreover, a long-term collision is likely to break the glass or damage the door/window. Meanwhile, the sound insulation effect is not satisfactory due to insufficient sealing. The technical problem sought to be solved by the present disclosure is therefore to ensure the sealing and fastening performances between the door/window body and the door/window frame.

SUMMARY

The purpose of the present disclosure is to solve the above-mentioned technical problem. A sliding door or window is provided and has the advantages of reasonable structure, good sound insulation effect and good fastening property.

To solve the above-mentioned technical problem, the present disclosure adopts a technical solution described below.

A sliding door or window is provided, including a door/window frame, two swing supporting mechanisms, two guiding structures and a handle. each swing supporting mechanism is arranged on a lower end of a respective side of the door/window frame. Each guiding structure is mounted on an upper end of the respective side of the door/window frame. Each swing supporting mechanism is provide with a first curved groove and the each guiding structure is provided with a pair of second curved grooves, and a drive shaft operative to slide along an orientation of the first curved groove is arranged within first curved groove. the handle disposed on the door/window frame is operative to drive the drive shaft to slide in the first curved groove, which forces at least one of the swing supporting mechanism or the guiding structure to swing.

The swing supporting mechanism comprises: a base and a pendulum member. The base is configured to be fixedly connected to a door or window. The pendulum member has a lower end hinged on the base. The first curved groove is provided on an upper end of the pendulum member, the drive shaft is arranged through the first curved groove and is slidable within the first curved groove, the drive shaft is connected to a sliding block which has an upper end drivingly connected to the handle of the door or window and which is operative to drive the drive shaft to slide in the first curved groove thereby forcing the pendulum member to swing around an axis of an articulated shaft, and a lower end of the pendulum member is connected to a roller configured to be mounted on a guide rail on a lower side of the door or window. The guiding structure comprises a right-angled connection casing configured to be mounted on the door or window. A fixed base is configured to be mounted on the door or window, a swing piece, a linkage piece, a first connection assembly, a second connection assembly, and at least one transmission belt. The fixed base is provided with a first cavity body, one end of the swing piece is provided with a guide wheel configured to be mounted on the door or window and to be engaged with a guide rail on an upper side of the door/window frame, and the other end of the swing piece extends into the first cavity body of the fixed base and is hinged in the first cavity body. The second curved grooves are provided on the other end of the swing piece that extends into the first cavity body. A limit shaft movable along the second curved grooves are disposed within the second curved grooves. The linkage piece is connected to the limit shaft and is operative to move along the second curved grooves together with the limit shaft, and the moving process forces the swing piece to swing around the axis of the articulated shaft, and an end of the linkage piece facing away from the limit shaft is fixedly connected to the first connection assembly.

The right-angled connection casing is provided with a second cavity body. The transmission belt extends through the second cavity body of the right-angled connection casing, and two ends of the transmission belt are connected to the first connection assembly and the second connection assembly respectively thereby achieving a linkage of the transmission belt. The first connection assembly and the second connection assembly. The two swing supporting mechanisms and the two guiding structures form a linkage structure with an opening at a lower end via a connection member.

DETAILED DESCRIPTION

Figure 1:
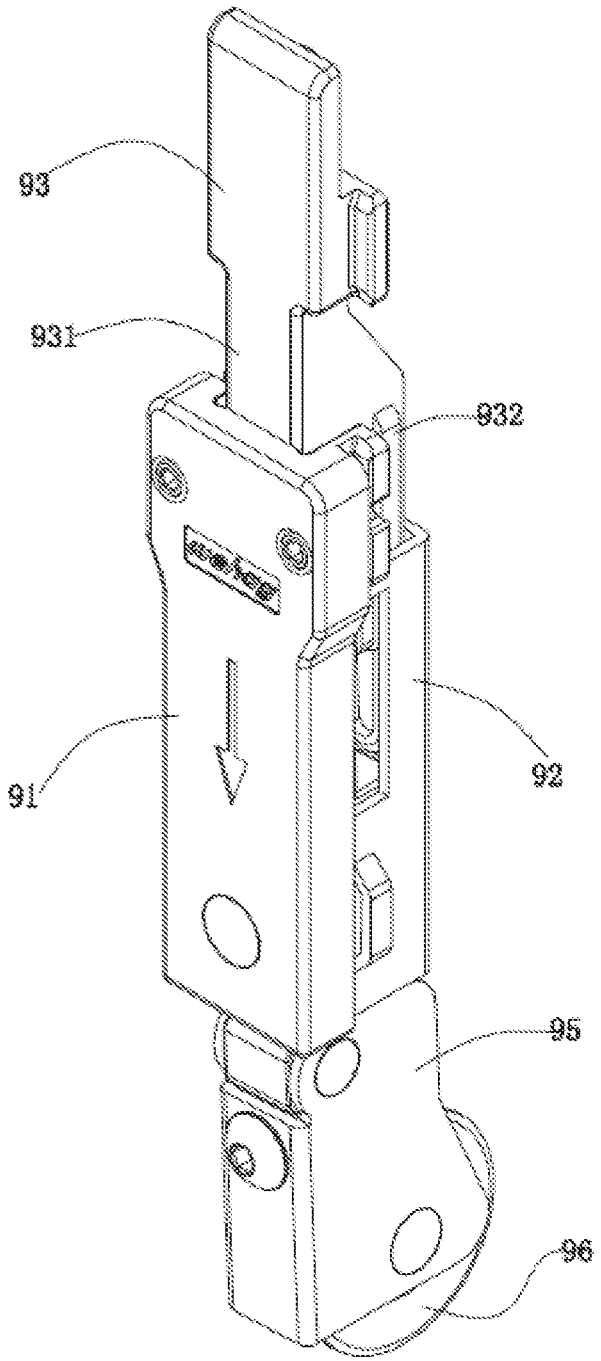
FIG. 1 is a perspective view of a swing supporting mechanism provided in the present disclosure.
Figure 2:
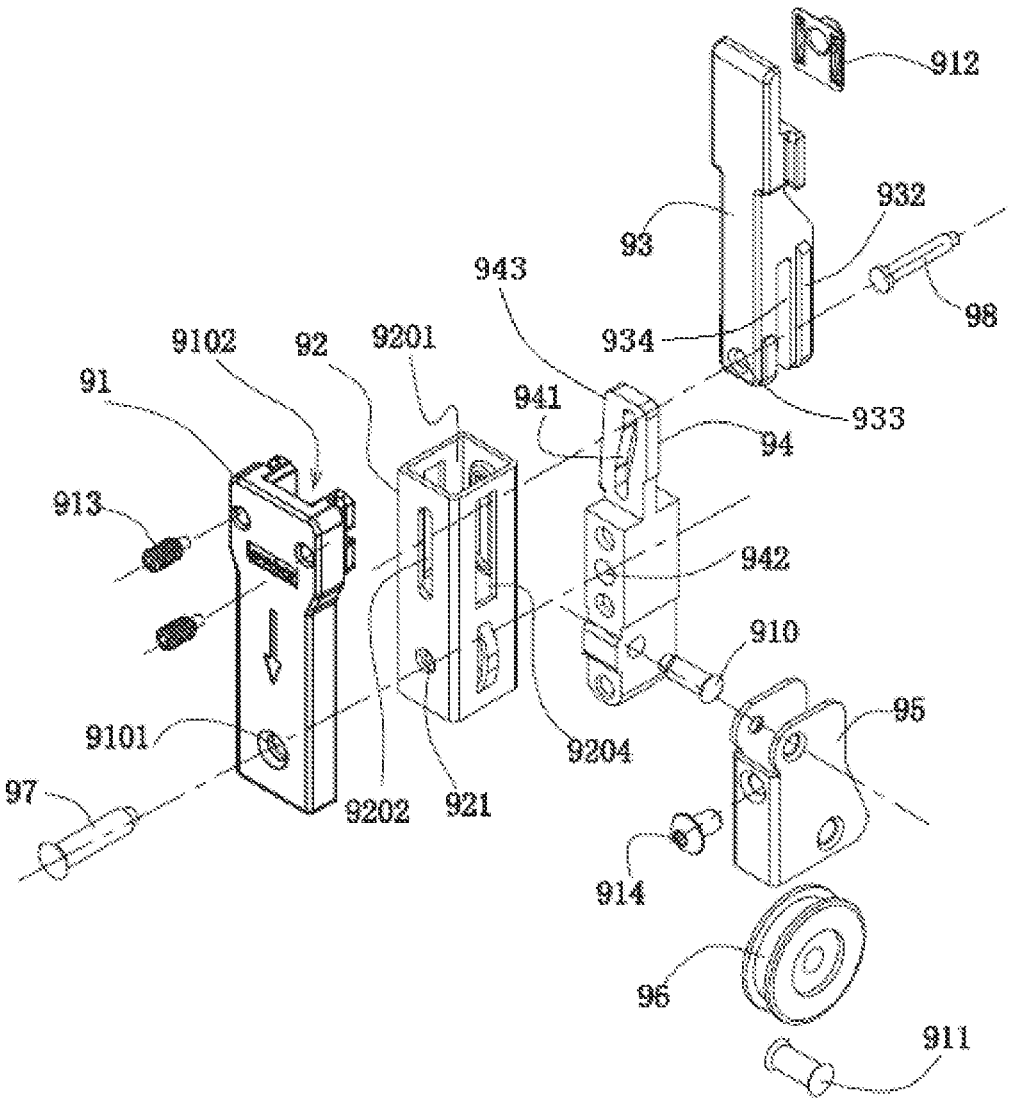
FIG. 2 is an exploded view of a swing supporting mechanism provided in the present disclosure.
Figure 3:
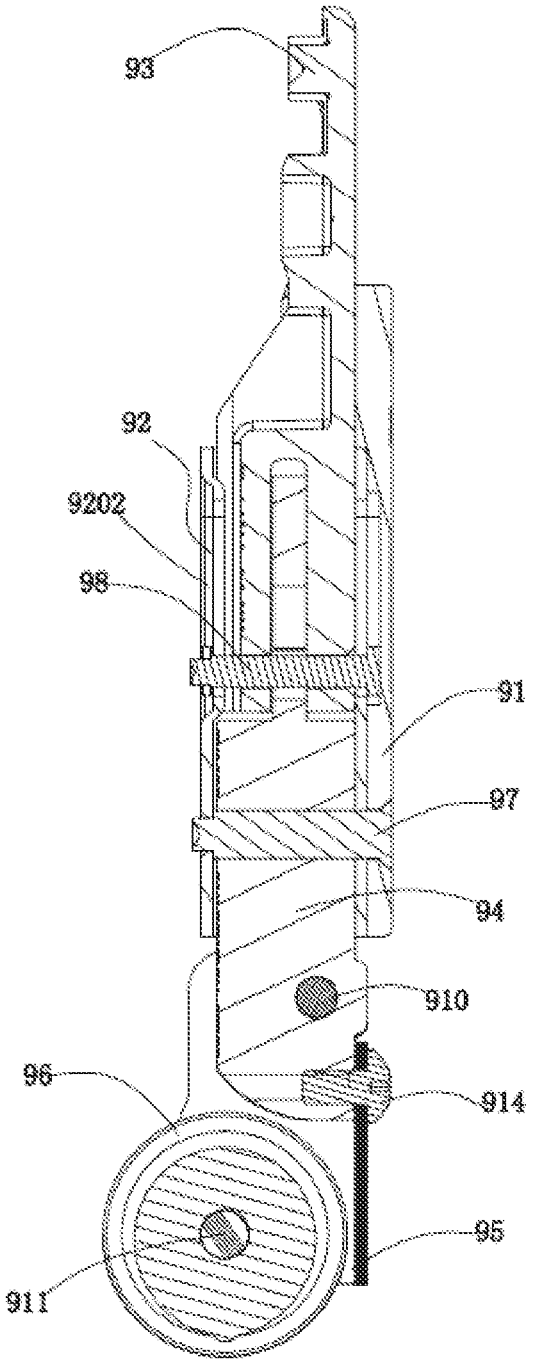
FIG. 3 is a cross-sectional view of a swing supporting mechanism provided in the present disclosure.
Figure 4:
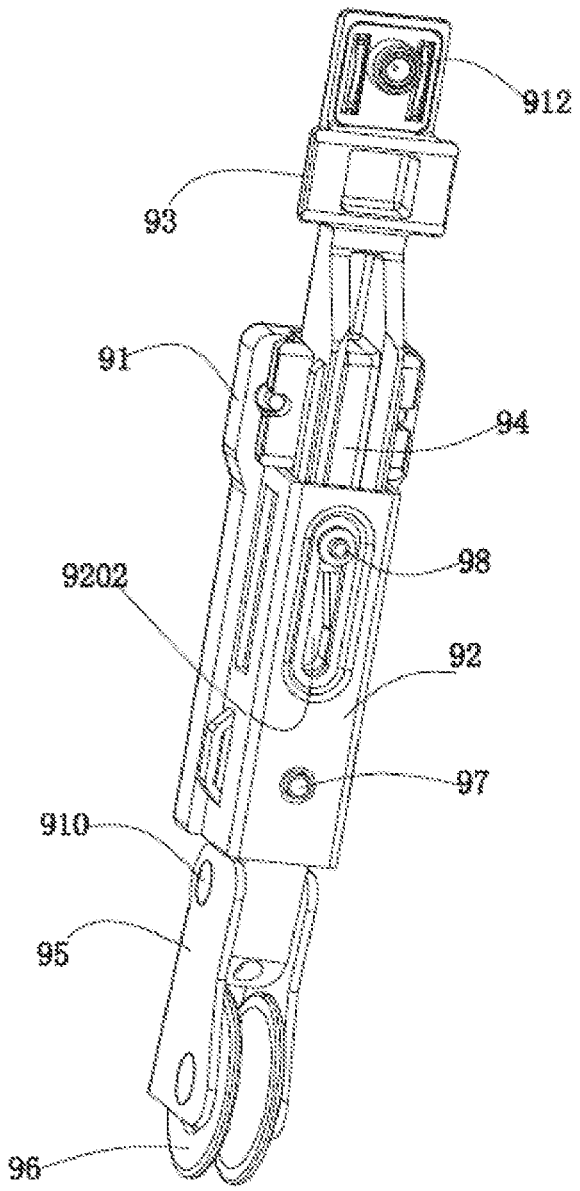
FIG. 4 is another perspective view of a swing supporting mechanism viewed from another direction provided in the present disclosure.
Figure 5:
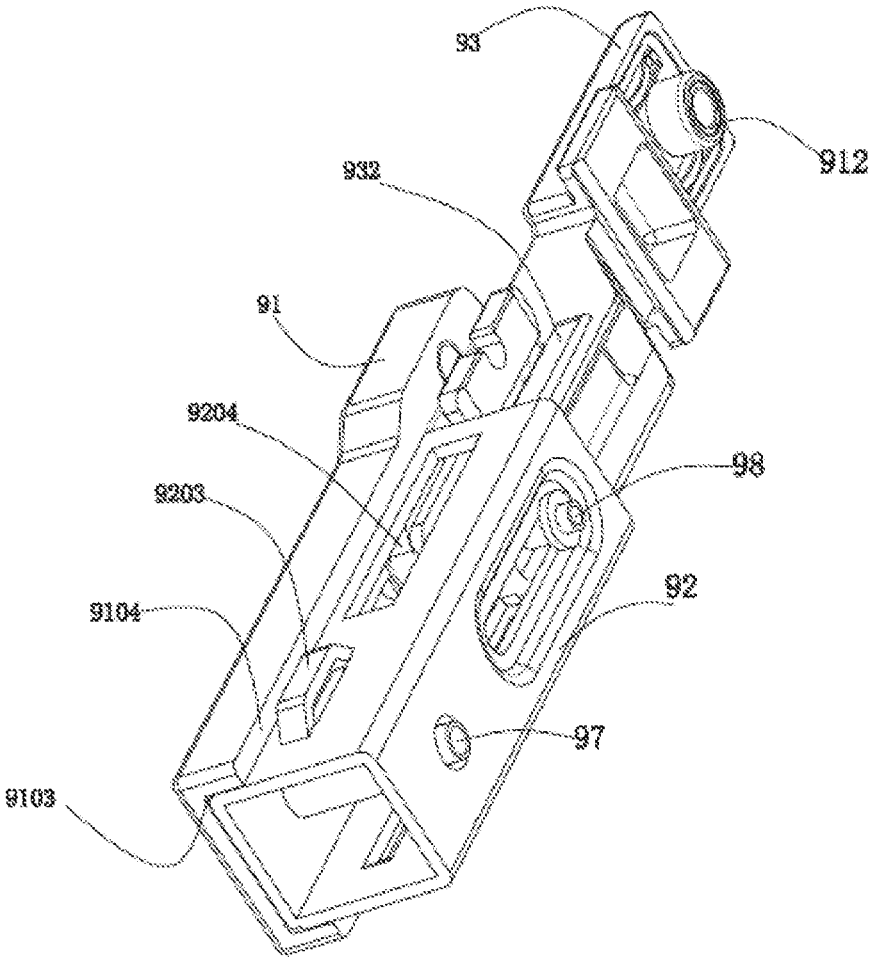
FIG. 5 is a perspective view of an assembly structure of a mounting bracket and a base in a swing supporting mechanism provided in the present disclosure.
Figure 6:
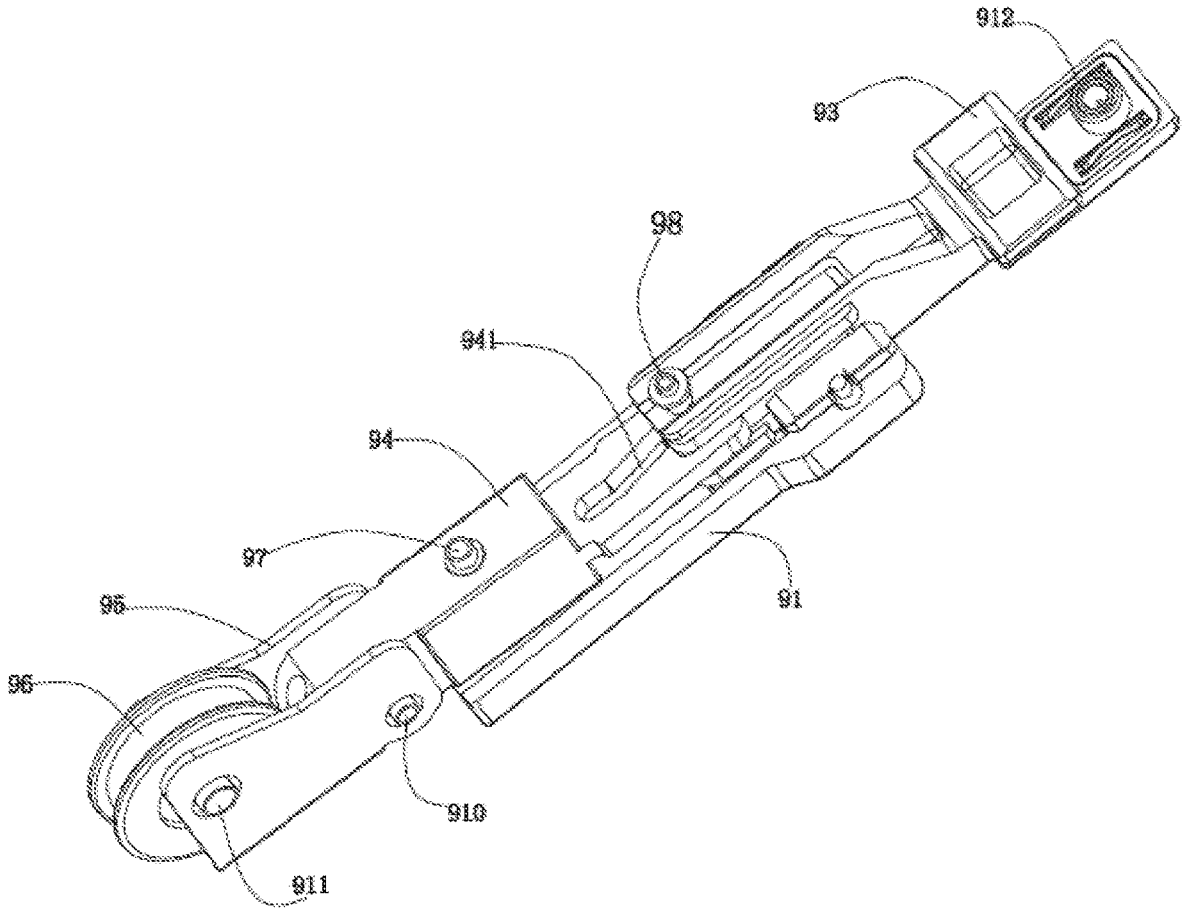
FIG. 6 is a perspective view of a swing supporting mechanism with the mounting bracket removed provided in the present disclosure.
Figure 7:
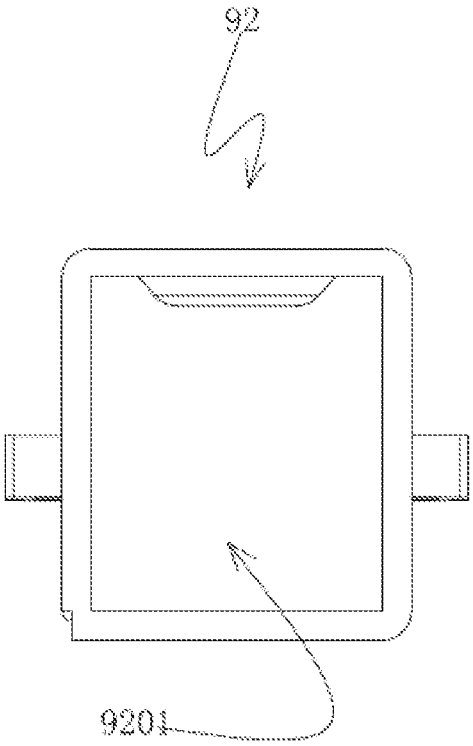
FIG. 7 is a top view of a mounting bracket in a swing supporting mechanism provided in the present disclosure.
Figure 8:
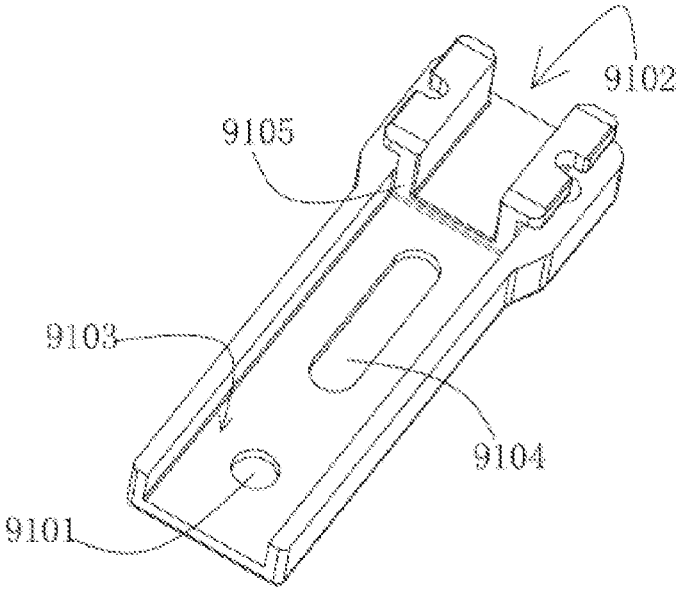
FIG. 8 is a perspective view of a base in a swing supporting mechanism provided in the present disclosure.
Figure 9:
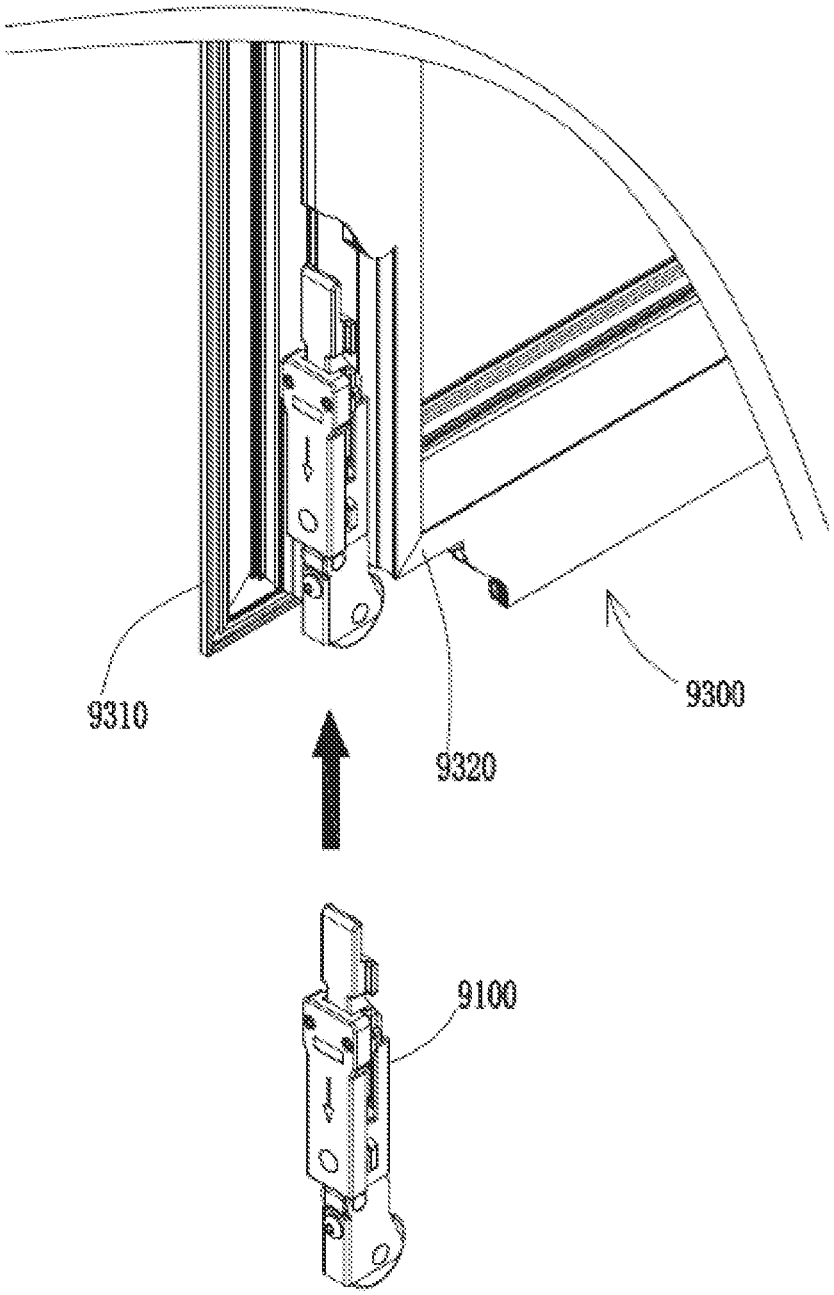
FIG. 9 is a fitting structural diagram of a swing supporting mechanism mounted on a window frame provided in the present disclosure.
Figure 10:
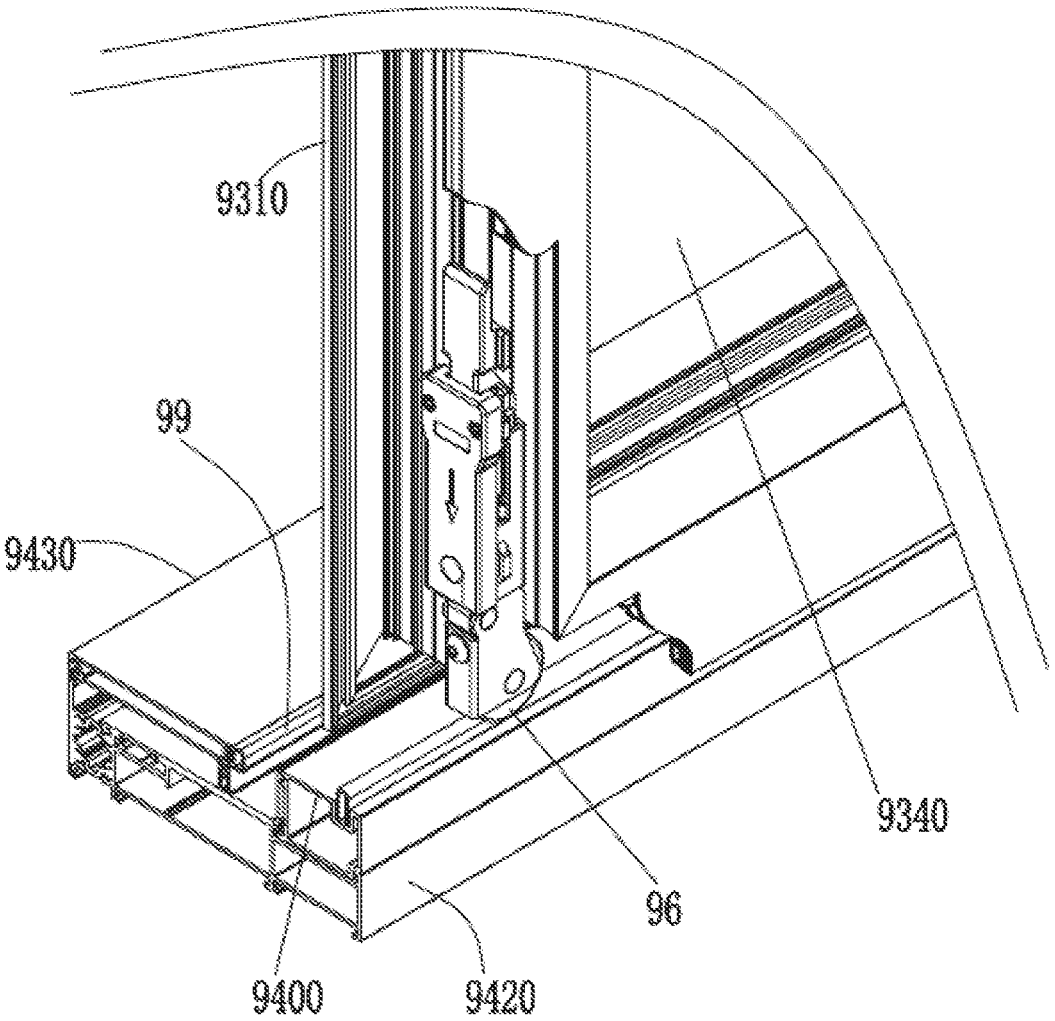
FIG. 10 is a structural diagram of a swing supporting mechanism, after being mounted on a window frame, fitting with a base of the window provided in the present disclosure.
Figure 11:
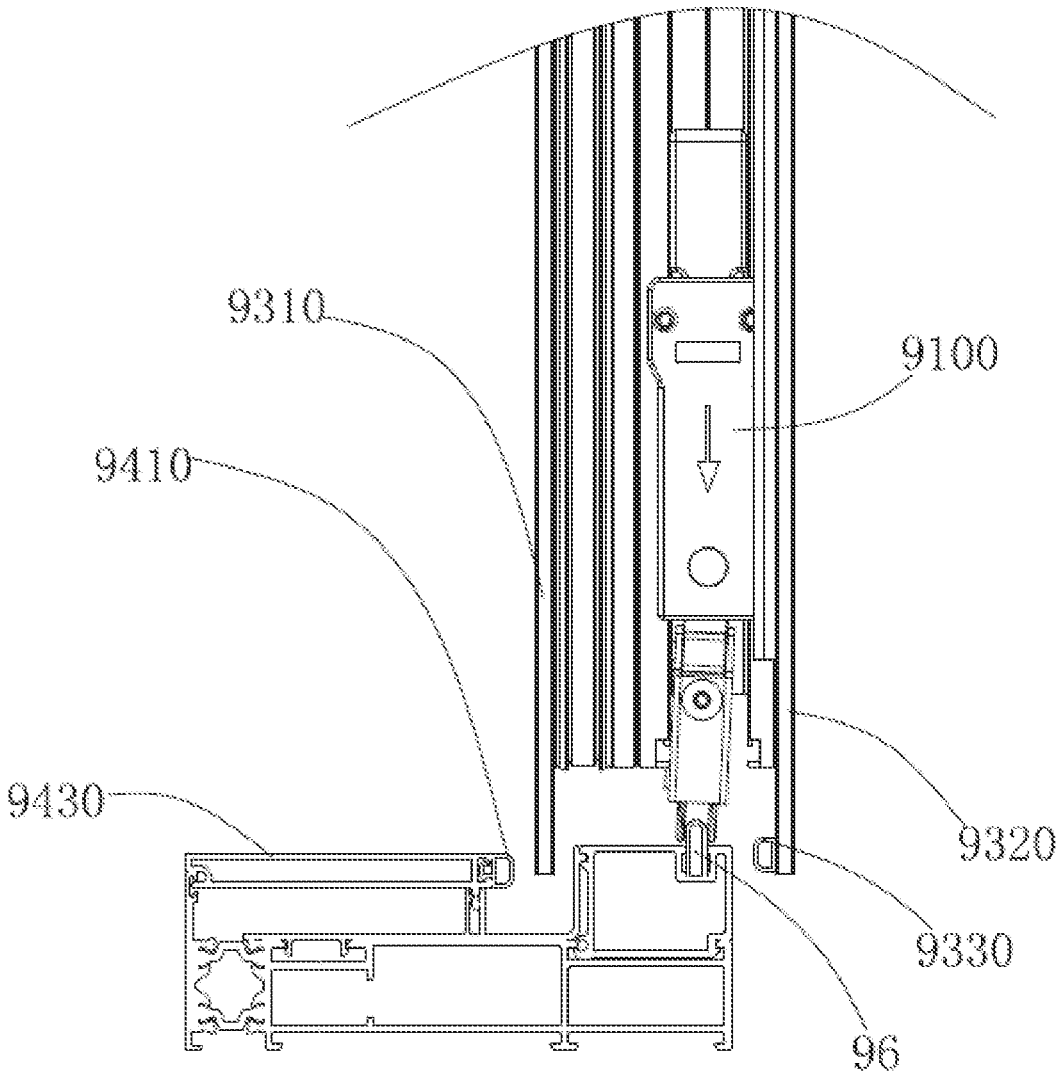
FIG. 11 is a structural diagram of a window frame in an unlocked state after a swing supporting mechanism is mounted on the window frame provided in the present disclosure.
Figure 12:
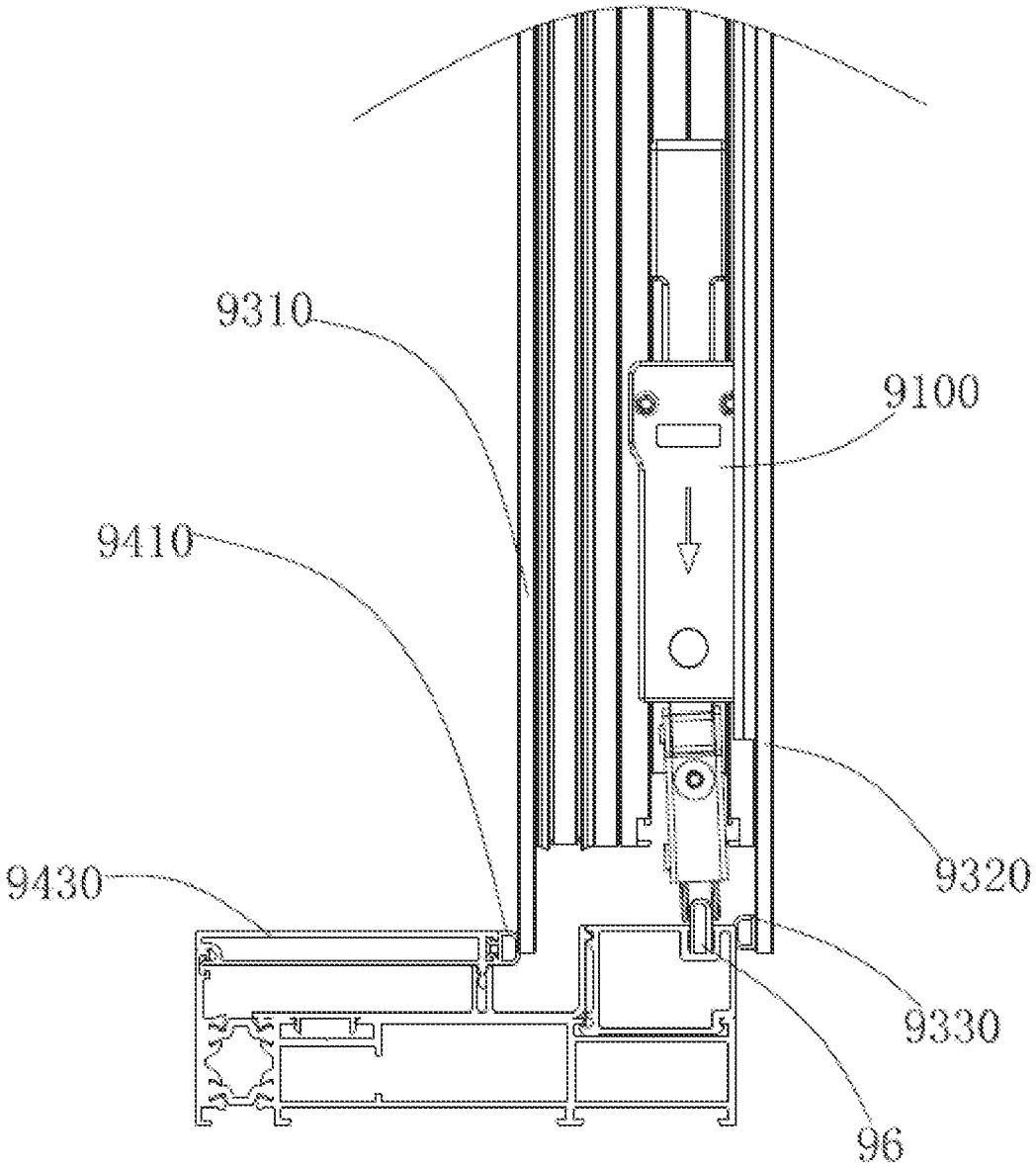
FIG. 12 is a structural diagram of a window frame in a locked state after a swing supporting mechanism is mounted on the window frame provided in the present disclosure.
Figure 13:
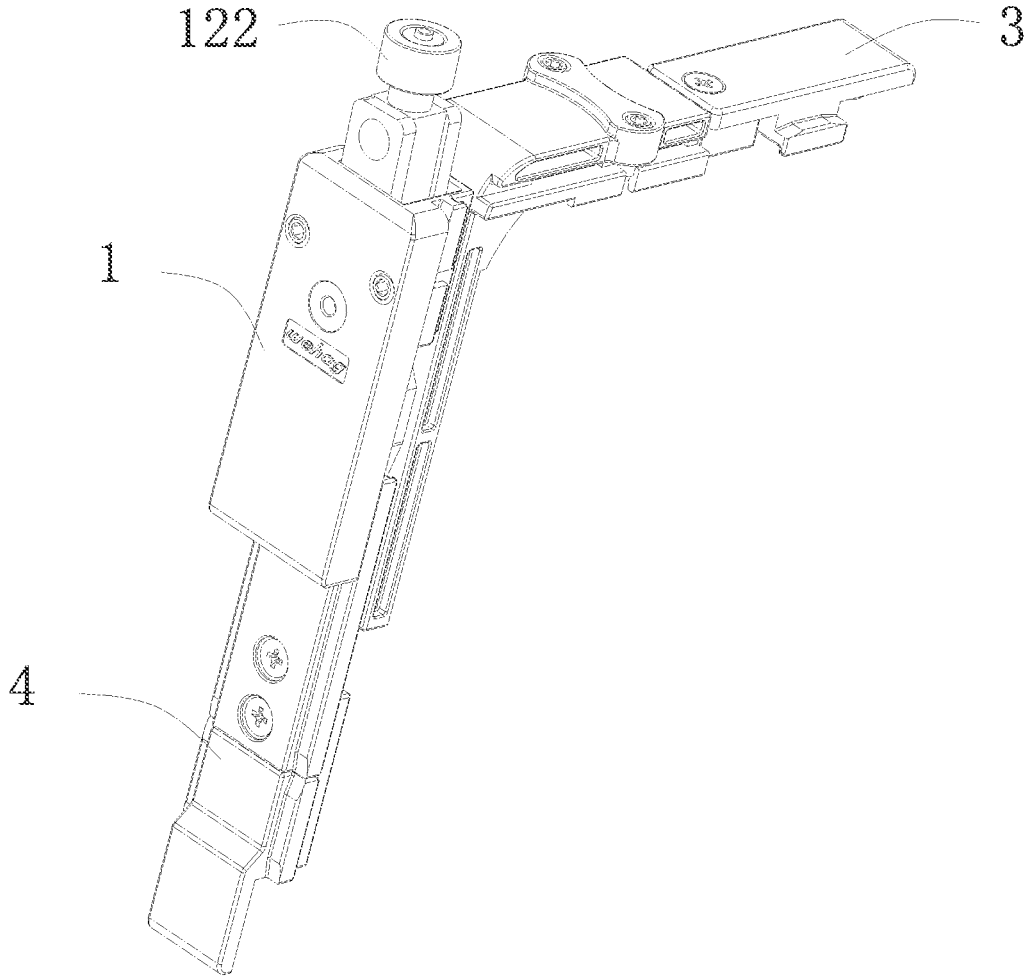
FIG. 13 is an overall structural diagram of a guiding structure provided in the present disclosure.
Figure 14:
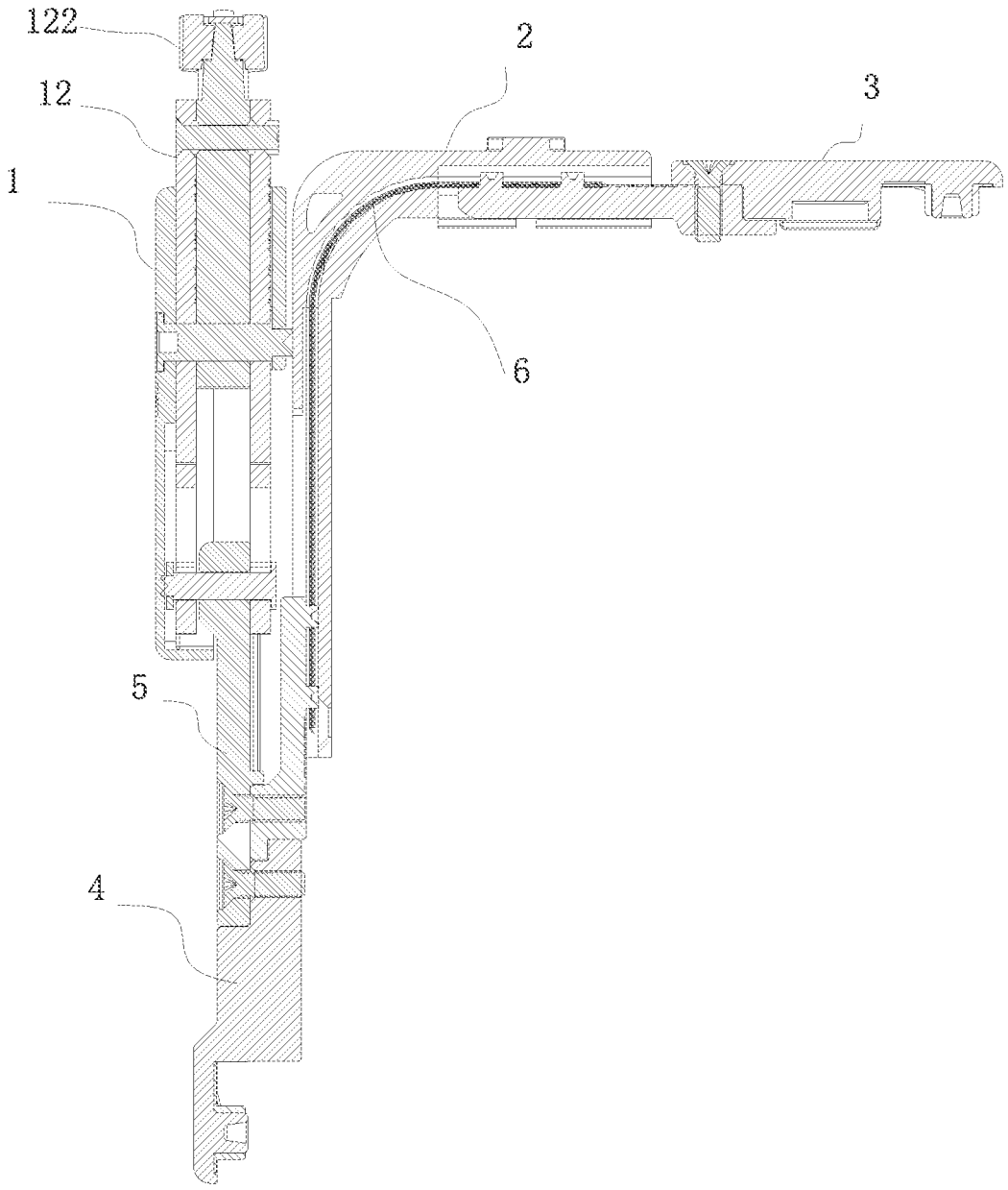
FIG. 14 is a structural diagram of a guiding structure provided in the present disclosure.
Figure 15:
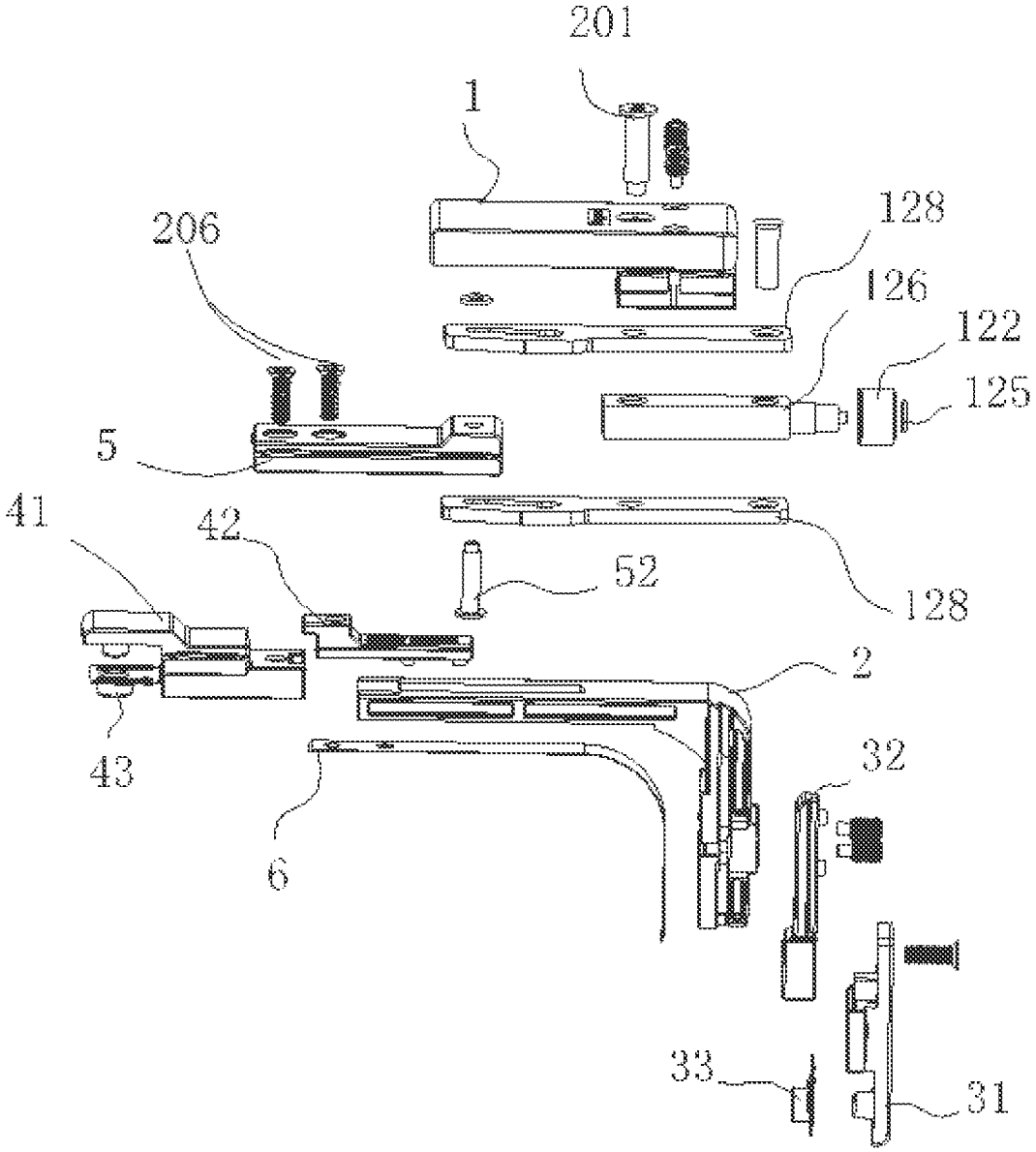
FIG. 15 is an assembly diagram of parts of the guiding structure provided in the present disclosure.

Embodiments of the present disclosure are described in detail below, and examples of the embodiments are illustrated in the drawings, where the same or similar reference numerals indicate the same or similar elements or elements having the same or similar functions. The embodiments described below with reference to the drawings are exemplary, intended to explain the present disclosure, and not to be construed as limiting the present disclosure.

In the description of the present disclosure, it is to be understood that the orientation or position relationships indicated by terms "center", "longitudinal", "lateral", "length", "width", "thickness", "above", "below", "front", "back", "left", "right", "vertical", "horizontal", "top", "bottom", "inside", "outside", "clockwise", "counterclockwise", etc. are based on the orientation or position relationships shown in the drawings, merely for facilitating description of the present disclosure and simplifying description, and do not indicate or imply that the apparatus or element referred to has a specific orientation and is constructed and operated in a specific orientation, and thus it is not to be construed as limiting the present disclosure.

Moreover, terms like "first" and "second" are for description only and are not to be construed as indicating or implying relative importance or implicitly indicating the number of technical features as indicated. Thus, a feature defined as a "first" feature or a "second" feature may explicitly or implicitly include one or more of this feature. As used herein, the term "plurality" is defined as two or more, unless otherwise expressly specified and limited.

In the present disclosure, unless otherwise expressly specified and limited, terms like "mounted", "connected to each other", "connected" or "fixed" are to be construed in a broad sense, for example, as permanently connected, detachably connected or integrated; mechanically connected or electrically connected; directly connected or indirectly connected via an intermediate medium; or internally connected between two elements. For those of ordinary skill in the art, the above terms can be construed according to specific circumstances in the present disclosure.

In the present disclosure, unless otherwise expressly specified and limited, when a first feature is described as "above" or "below" a second feature, the first feature and the second feature may be in direct contact, or be in contact via another feature between the two features. Moreover, when the first feature is described as "on", "above" or "over" the second feature, the first feature is right on, above or over the second feature or the first feature is obliquely on, above or over the second feature, or the first feature is at a higher level than the second feature. When the first feature is described as "under", "below" or "underneath" the second feature, the first feature is right under, below or underneath the second feature or the first feature is obliquely under, below or underneath the second feature, or the first feature is at a lower level than the second feature.

The present disclosure will be further described in detail in conjunction with the drawings and specific embodiments.

Referring to FIGS. 1 to 9, they show a swing supporting mechanism 9100 configured to be mounted on a door or window. The swing supporting mechanism 9100 includes a base 91 configured to be fixedly connected to the door or window. The base 91 is provided with a profile snap groove 9106 for snap fit of a door or window profile. The swing supporting mechanism 9100 further includes a pendulum member 94 a lower end of which is hinged on the base 91. An upper end of the pendulum member 94 is provided with a first curved groove 941 inside which a drive shaft 98 is disposed through the first curved groove 941 and is slidable in the first curved groove 941. The drive shaft 98 is connected to a sliding block 93 whose upper end is drivingly connected to a handle of the door or window, and the sliding block 93 can drive the drive shaft 98 to slide in the first curved groove 941 so as to force the pendulum member 94 to swing around an axis of an articulated shaft. A shock-absorbing muffling spacer 912 is disposed on the sliding block 93. Since the first curved groove 941 is disposed on the pendulum member 94, the pendulum member 94 may generate a certain lateral displacement in response to sliding the drive shaft in the snakelike groove. Due to the obstruction of the articulated shaft of the pendulum member, the pendulum member 94 swings around the axis of the articulated shaft and thus drives a roller 96 to swing. In response to being limited by the displacement, the roller 96 generates a reversed force to the pendulum member 94, and thereby the base 91 is forced to generate a certain displacement. A lower end of the pendulum member 94 is connected to the roller 96 configured to be mounted on a guide rail of the door or window. The roller 96 is mounted at the lower end of the pendulum member 94 via a bracket 95. Specifically, the bracket 95 is mounted at the lower end of the pendulum member 94 via a pin shaft 910 and a screw 914, and the roller 96 is mounted on the bracket 95 via a bracket shaft 911. In an exemplary embodiment, the roller 96 is a U-shaped groove wheel made of an elastic material.

In an exemplary embodiment, the swing supporting mechanism 9100 further includes a mounting bracket 92. The mounting bracket 92 is provided with a cavity 9201 through which the pendulum member 94 may be inserted, and the cavity 9201 may be also available to the pendulum member 94 for swinging to a certain extent. The mounting bracket 92 is further provided with a pair of vertically extending grooves 9202 communicating with the cavity 9201 on opposite sides of the mounting bracket 92. Two ends of the drive shaft 98 are movably snap-fitted to the vertically extending grooves 9202, respectively. A lower end of the sliding block 93 is inserted into the cavity 9201 and connected to the drive shaft 98 via a hole 933 disposed at the lower end of the sliding block 93. For better balance, the lower end of the sliding block 93 is provided with a U-shaped through groove 934, and the upper end of the pendulum member 94 is provided with a sheet-shaped lug 943 insertable into the U-shaped through groove 934. The first curved groove 941 is disposed on the lug 943 so that the lug 943 may slide in the U-shaped through groove 934. The lower end of the pendulum member 94 extends outside the cavity 9201 and is connected to the bracket 95 and the roller 96. The middle of the pendulum member 94 is provided with a first hinge hole 942, a lower end of the mounting bracket 92 is provided with a second hinge hole 921, a lower end of the base 91 is provided with a third hinge hole 9101, and the pendulum member 94, the mounting bracket 92 and the base 91 are connected via a rotating shaft 97 mated with the three hinge holes. In this way, the pendulum member 94 can swing to some extent around the rotating shaft 97 in the cavity 9201 of the mounting bracket 92. To ensure a good swinging effect and a sufficient swinging travel of the lug 943 during the swinging process, a portion of the mounting bracket 92 corresponding to the lug 943 is provided with a swing window 9204, so that a part of the lug 943 can be swung outside the swing window 9204 during the swinging process of the pendulum member 94.

In an exemplary embodiment, a mounting groove 9103 is disposed on one side of the base 91 close to the pendulum member 94. A guide groove 9102 is disposed at an upper end of one side of the base 91 close to the mounting bracket 92. The sliding block 93 is provided with a guide portion 931 for snap-fitting with the guide groove 9102. The mounting groove 9103 is disposed below the guide groove 9102, and a limit structure for engaging the mounting bracket 92 is disposed between the guide groove 9102 and the mounting groove 9103. Specifically, the limit structure is a limit platform 9105 protruding outside the guide groove 9102.

In an exemplary embodiment, the guide groove 9102 and the mounting groove 9103 are both square grooves and are consistent in direction, and a width of the guide groove 9102 is smaller than a width of the mounting groove 9103. The mounting bracket 92 is in a quadrilateral cylindrical shape and has a side surface abutted against a bottom of the mounting groove 9103 for snap-fitting engagement. One end of the mounting bracket 92 abuts against a boss protruding outside the guide groove 9102. The sliding block 93 is further provided with a guide boss 932 which is snap-fitted with an opening rim of the guide groove 9102. In this way, in response to inserting the sliding block 93 into the mounting bracket 92, the guide portion 931 of the sliding block 93 is attached to the bottom wall of the guide groove 9102 on the base 91, and the guide boss 932 is attached to the opening rim of the guide groove 9102 on the base 91. The profile snap grooves 9106 are symmetrically disposed on the base 91 outside the guide groove 9102.

In an exemplary embodiment, a receiving groove 9104 is disposed in the mounting groove 9103, the length of the receiving groove 9104 is equivalent to the length of the straight groove 9202, and the receiving groove 9104 is used for one end of the drive shaft 98 to slide in. The receiving groove 9104 is disposed to prevent the drive shaft from interfering with the base 91 during the movement.

In an exemplary embodiment, the sliding block 93 is provided with a shock-absorbing muffling spacer 912 for preventing the noise generated by friction with the door or window during the movement of the sliding block 93.

Referring to FIGS. 9 to 12, the swing supporting mechanism 9100 used in a sliding window of the embodiment 1 is mounted on a window, and the window includes a window base 9430, a window frame 9300, a window glass 9340, a window guide rail 9400, and an outer end surface 9420 of the base. The window frame 9300 includes an inner window frame 9310, an outer window frame 9320, and a sealing strip 99 that can be sealingly engaged with the outer end surface 9420 of the base and an outer end surface of the inner window frame 9310. The swing supporting mechanism 9100 is pushed upward from the bottom of the window frame 9300, and the profile on the window frame 9300 is engaged with the profile snap groove 9106 on the base 91, so that the swing supporting mechanism 9100 is snap-fitted on the window frame 9300. After sliding to a proper position, the swing supporting mechanism 9100 is fastened to the window frame 9300 via a headless screw 913. At this time, the roller 96 is just fitted with the window guide rail 9400, and the sliding block 93 on the swing supporting mechanism 9100 is drivingly connected to a handle (not shown) on the window via a linkage mechanism (not shown). In response to rotating the handle on the window in one direction, the linkage mechanism drives the sliding block 93 to slide downward to drive the pendulum member 94 to swing around the rotating shaft 97, so that the roller 96 connected to the pendulum member 94 swings toward the side of the outer window 9320. The roller 96 generates a reverse thrust due to the limit of the window guide rail 9400, and the reverse thrust is transmitted to the base 91 via the pendulum member 94, so that the window frame 9300 fixedly connected to the base 91 moves toward the side of the inner window frame 9310. In response to determining that the outer end surface 9420 of the base and the outer end surface of the inner window frame 9310 are tightly pressed with the sealing strip 99, the fastening and sealing functions are achieved. On the contrary, in response to rotating the handle on the window in the other direction, the linkage mechanism drives the sliding block 93 to slide upward, and the window frame 9300 moves towards the side of the outer window frame 9320. In response to determining that the outer end surface 9420 of the base and the outer end surface of the inner window frame 9310 are separated from the sealing strip 99, the locking is released, and the window can be pushed and pulled at will.

Of course, with the same principle, the swing supporting mechanism 9100 of the embodiment 1 may also be used in the sliding door. The principles of fastening and sealing are as above, and will not be described in detail again.

To better apply the swing supporting mechanism 9100 to the door or window, in the present disclosure, as shown in FIGS. 13 to 20, a guiding structure 9200 is further disposed on the door or window frame. Specifically, the guiding structure 9200 includes a right-angled connection casing 2 configured to be mounted on the door or window, a fixed base 1, a swing piece 12, a linkage piece 5, a first connection assembly 4, a second connection assembly 3 and at least one flexible transmission belt 6 which are configured to be mounted on the door or window. In the embodiment of the present disclosure, three flexible steel belts are adopted.

The fixed base 1 is provided with a first cavity body. One end of the swing piece 12 is provided with a guide wheel configured to be mounted on a guide rail on an upper side of the door or window frame, and the other end of the swing piece 12 extends into and is hinged in the first cavity body of the fixed base 1. The swing piece 12 includes two identical swing plates 128 and a square shaft 126 disposed between the two swing plates 128. The two swing plates 128 are symmetrically disposed on two sides of one end of the square shaft. The swing plates 128 and the square shaft 126 are screwed together by a first screw 206 and are further hinged in the first cavity body of the fixed base 1 via a rotating shaft 201. In this way, it can be realized that the swing plates 128 and the square shaft 126 is fixedly connected into a whole, and the whole composed of the swing plates 128 and the square shaft 126 can rotate around the rotation shaft 201. One end of the square shaft 126 extends out of the swing plates 128, and the guide wheel 122 is disposed at this end. One end of the guide wheel 122 facing away from the square shaft 126 is further provided with a muffling spacer 125 that may reduce noise generated by friction or impact between the end of the guide wheel 122 and the door or window frame during rolling of the guide wheel 122. Each of the swing plates 128 has one end not attached to the square shaft 126, and this end of each of the swing plates 128 is provided with a pair of second curved grooves 130. A linkage piece 5 is further disposed between the two swing plates 128. After a limit shaft 52 extends through the linkage piece 5, two ends of the limit shaft 52 are respectively disposed in the second curved grooves 130 of the swinging plates 128 to achieve that the limit shaft 52 move along the second curved grooves 130 together with the linkage piece 5. Moreover, during the movement, the limit shaft 52 and the linkage piece 5 may just move linearly. However, the grooves of the second curved grooves 130 are similar to an "S" shape, so the swinging plates 128 and the square shaft 126 are forced to rotate around the rotating shaft 201 during the linear movement of the limit shaft 52 and the linkage piece 5 in the cavity of the fixed base 1.

In an exemplary embodiment, the first connection assembly 4 is fixedly connected to an end of the linkage piece 5 facing away from the limit shaft 52. The first connection assembly includes a first connection piece 41 and a first transmission piece 42. The first connection piece 41 is screwed onto the linkage piece 5 via a screw 206, and the first transmission piece 42 is screwed onto the linkage piece 5 via a screw, so that it is realized that the first connection piece 41 and the first transmission piece 42 are fixedly connected to the linkage piece 5. The second connection assembly 3 includes a second connection piece 31 and a second transmission piece 32, and the second connection piece 31 is screwed onto the second transmission piece 32 via the screw 206. The right-angled connection casing 2 is provided with a cavity for the transmission belt 6 to extend through. The transmission belt 6 is inserted in the cavity. The first transmission piece 42 and the second transmission piece 32 are connected by the flexible transmission belt 6 so as to achieve a linkage of the first transmission piece 42, the transmission belt 6 and the second transmission piece 32, and then achieve a linkage of the linkage piece 5, the first connection assembly 4, the transmission belt 6 and the second connection assembly 3. The first connection assembly 4 and the second connection assembly 3 are connected to the handle of the window. A person applies a force to the handle, the handle is rotated and drives the first connection assembly 4 and the second connection assembly 3. The handle can also be rotated in a reverse direction, and thus the first connection assembly 4 and the second connection assembly 3 can be driven in the reverse direction.

In an exemplary embodiment, one end of the right-angled connection casing 2 is provided with a first sliding groove along which the first transmission piece 42 may move, and the other end of the right-angled connection casing 2 is provided with a second sliding groove along which the second transmission piece 32 may move.

In an exemplary embodiment a first shock-absorbing muffling spacer 43 is disposed at one end of the first connection piece 41 facing away from the right-angled connection casing 2 for preventing noise generated by impact or friction between the first connection piece 41 and the door or window during the movement of the first connection piece 41. A second shock-absorbing muffling spacer 33 is disposed at one end of the second connection piece 31 facing away from the right-angled connection casing 2 for preventing noise generated by impact or friction between the second connection piece 31 and the door or window during the movement of the second connection piece 31.

The working principle of the present disclosure is described as follows. The guide wheel 122 is disposed in the guide rail 502 of the window mounting frame, and the fixed base 1 and the right-angled connection casing are fixed on the window frame 501. The first connection assembly 4 and the second connection assembly 3 are connected to the handle. The connection mode of the above connection may be that: the first connection assembly 4 is connected to one end of the handle via a steel wire, and the second connection assembly 3 is connected to the other end of the handle via another steel wire. In response to determining that the handle rotates around the center thereof, the first connection assembly 4 and the second connection assembly 3 may be driven to move respectively along the first sliding groove and the second sliding groove.

Figure 17:
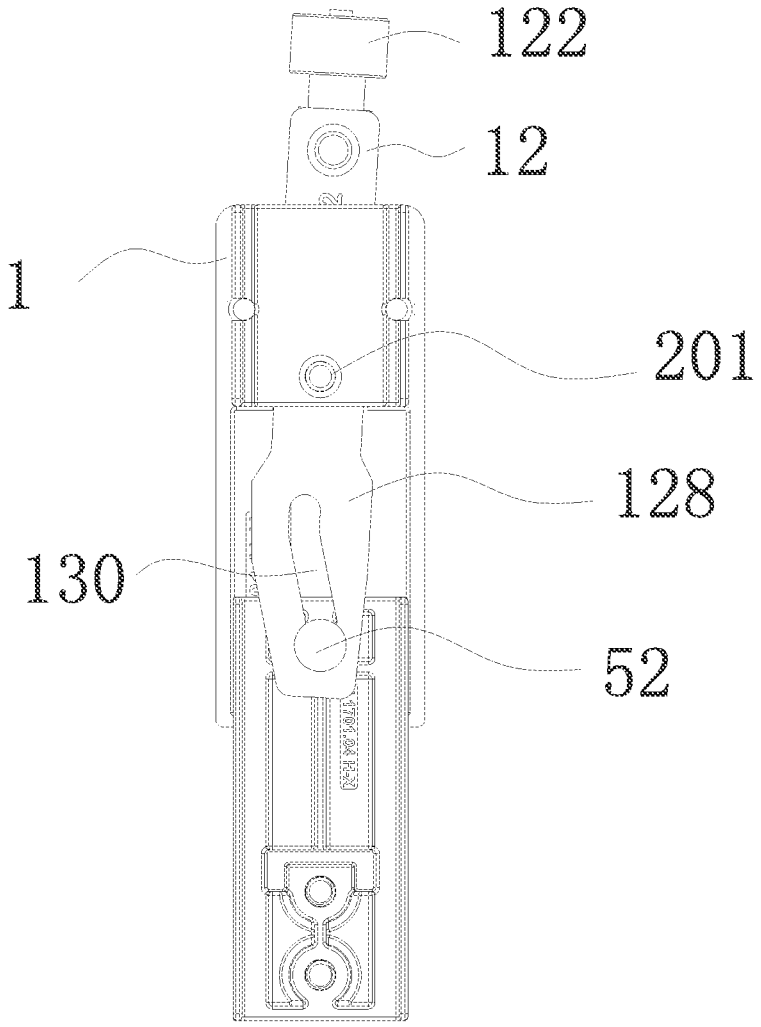
FIG. 17 is a diagram of a working principle of a guiding structure provided in the present disclosure.
Figure 18:
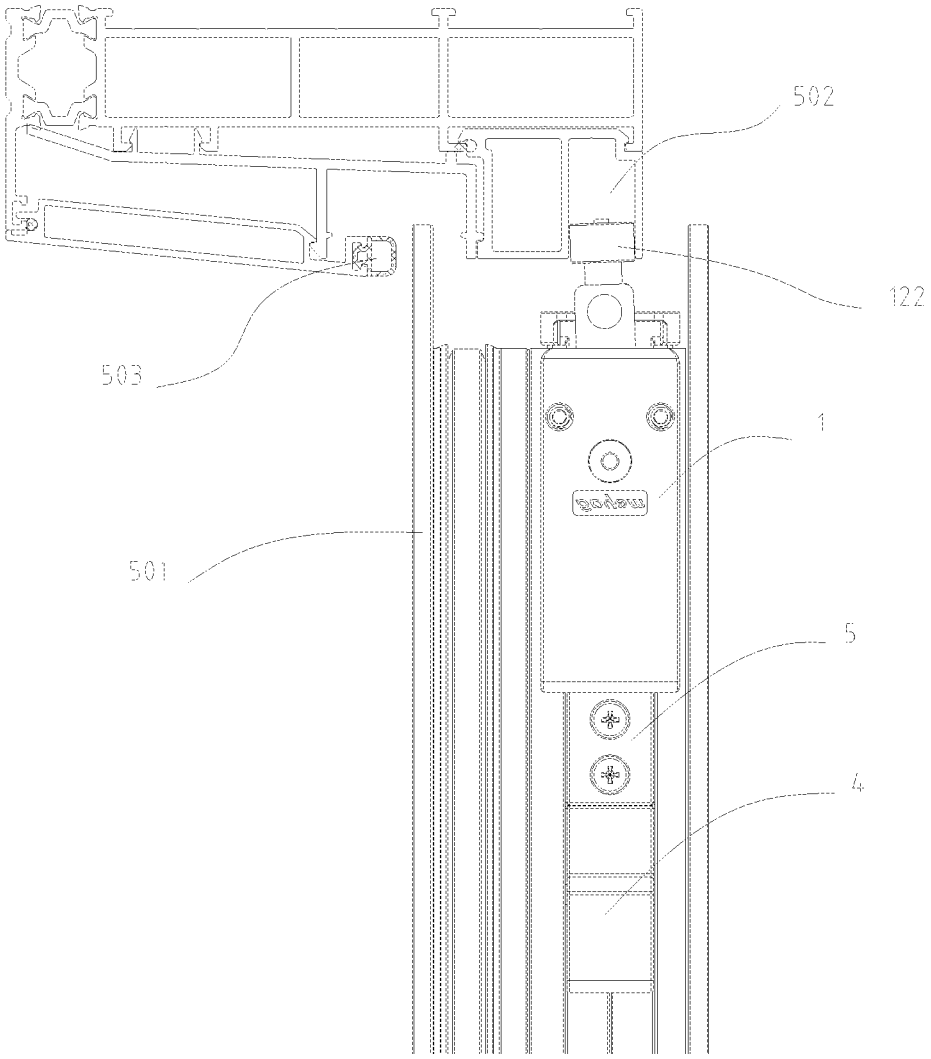
FIG. 18 is a diagram of a guiding structure in an unlocked state provided in the present disclosure.

In response to determining that the window is in an unlocked state, referring to FIGS. 17 and 18, at this time the limit shaft 52 is located at the lower end of the second curved grooves 130. The sealing strip 503 is not in contact with the window frame 501, so the window may be moved at will. The door or window has the same effect as the ordinary sliding door or window.

In response to transforming the window from an unlock state to a locked state, the handle is rotated and the second connection assembly 3 is driven by the handle to move in a direction away from the right-angled connection casing 2. The second connection assembly 3 and the first connection assembly 4 are linked, so the first connection assembly 4 moves upward, the linkage piece 5 is driven by the first connection assembly 4 to move upward, and the limit shaft 52 is driven by the linkage piece 5 to move upward along the curved groove 130. Since the linkage piece 5 can just do linear motion, the swing piece 12 is forced to move laterally. However, the swing piece 12 and a mounting outer frame of the window are fixed in a lateral direction and cannot be movable, so relatively speaking, just the window frame 501 connected to the fixed base 1 may be moved laterally as a whole. After the lateral movement, the window frame 501 is pressed against the sealing strip 503. The window is then in the locked state.

Figure 16:
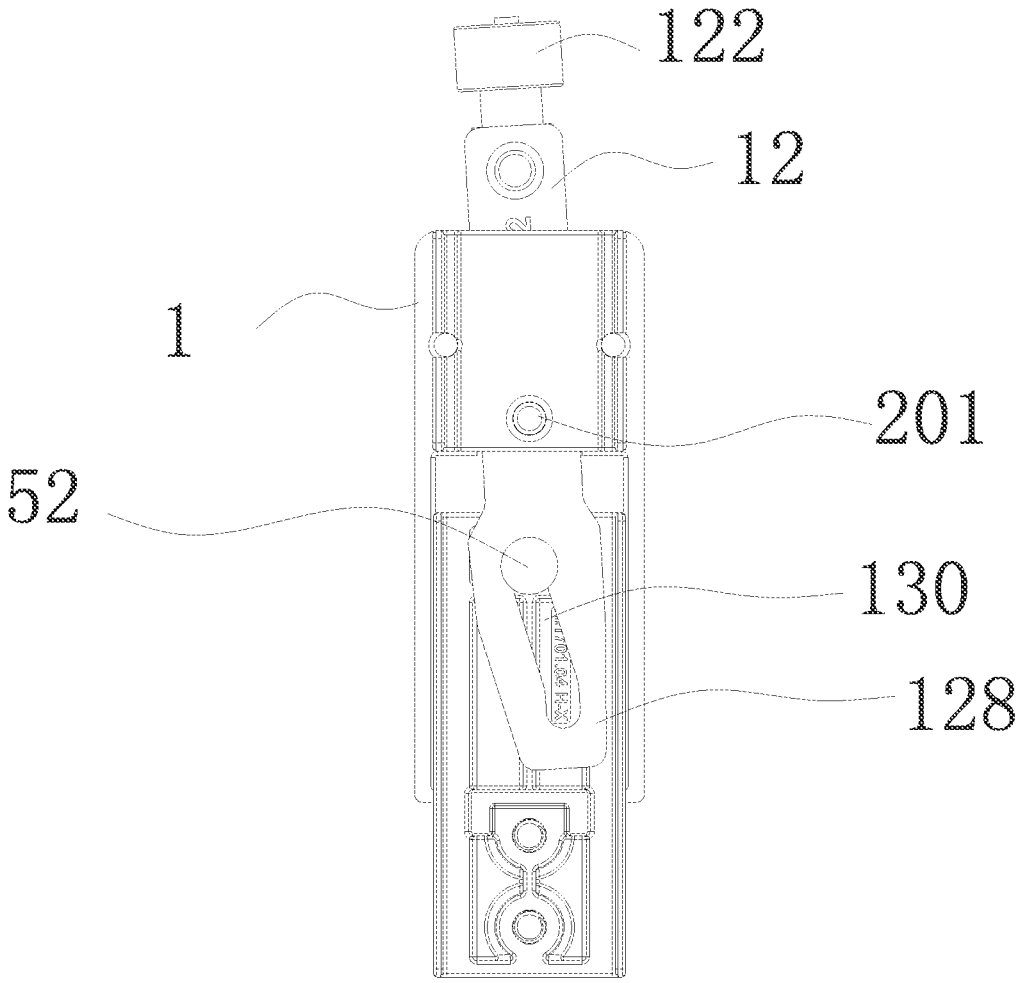
FIG. 16 is a diagram of a working principle of a guiding structure provided in the present disclosure.
Figure 19:
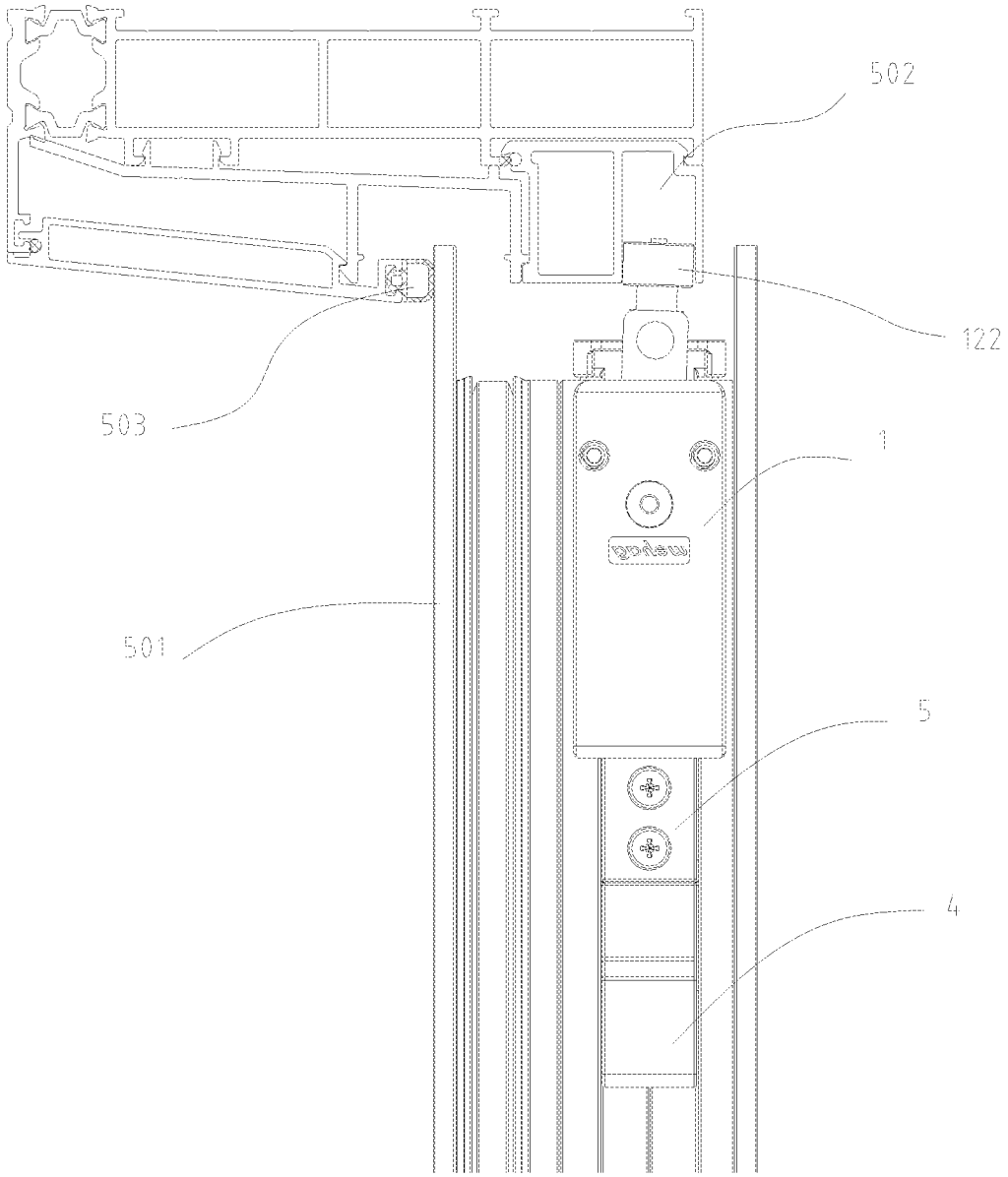
FIG. 19 is a diagram of a guiding structure in a locked state provided in the present disclosure.

In response to determining that the window is in the locked state, referring to FIGS. 16 and 19, at this time, the sealing strip 503 is in contact with and pressed against the window frame 501, so that the window frame 501 cannot be moved. Moreover, since no gap exists between the window frame 501 and the sealing strip 503, even if receiving an external force such as wind power, the window frame 501 does not impact with the sealing strip 503 or the mounting outer frame of the window. Thus, the noise is avoided. In addition, the sealing and sound insulation effects of the window are greatly improved.

For the above-mentioned locked and unlocked states, it should be illustrated that in the unlocked state, the limit shaft 52 is not necessarily located at the lower end of the curved groove 130, but may be located at the upper end of the curved groove 130. This may be changed depending on situations.

Figure 20:
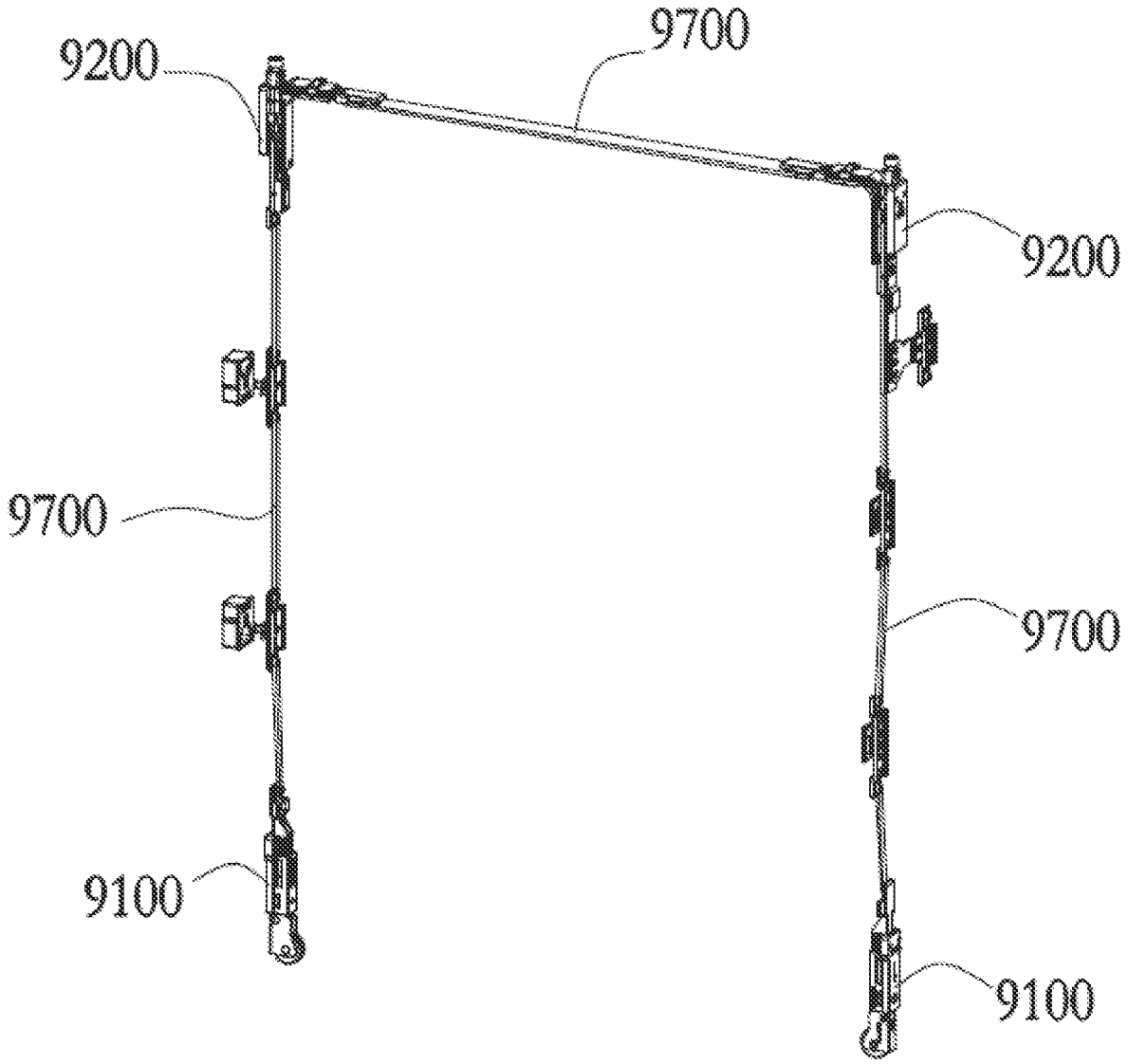
FIG. 20 is a schematic diagram of a connection structure of a guiding structure of a swing supporting mechanism provided in the present disclosure.
Figure 21:
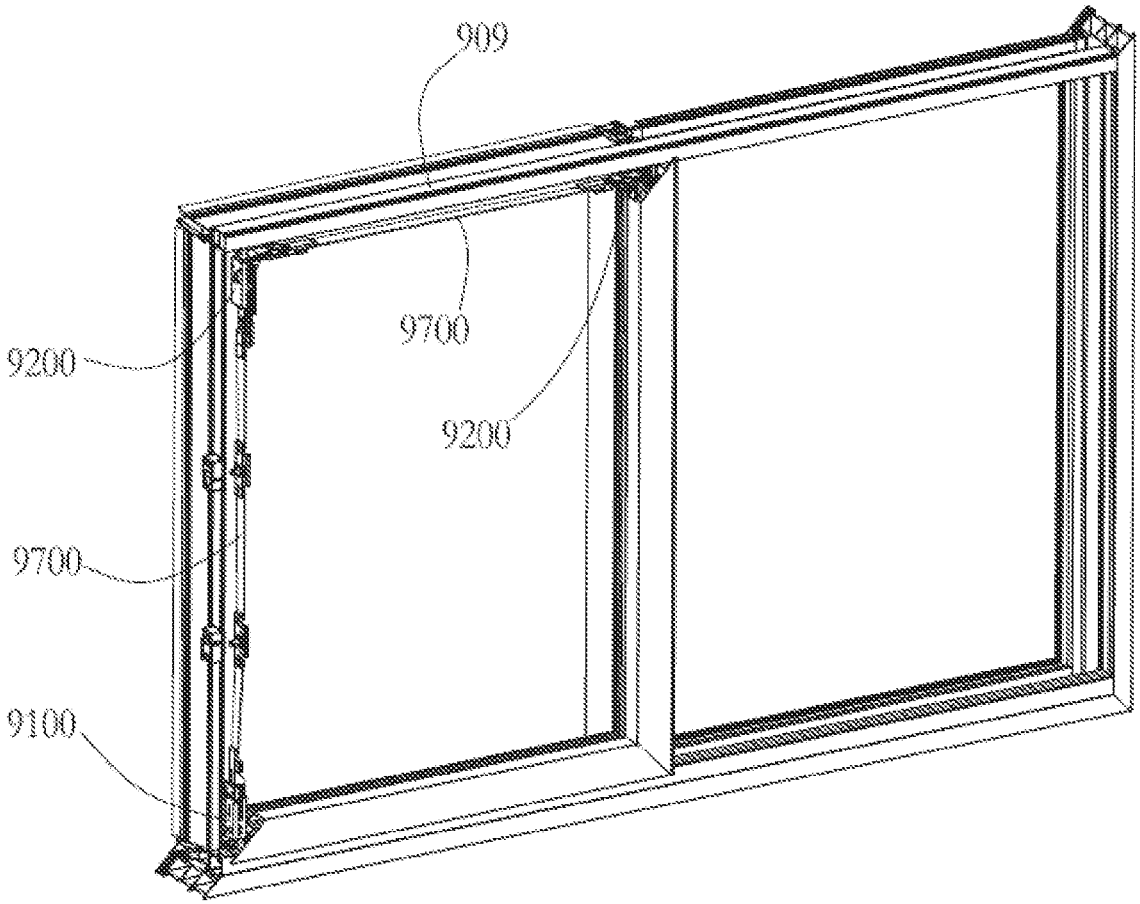
FIG. 21 is a partial cut-away perspective view of an assembled relationship provided by the present disclosure.

Referring to FIGS. 20 and 21, two swing supporting mechanisms 9100 are provided at the lower end of the side of the door/window frame 909, two guiding structures 9200 are mounted at the upper end of the side of the door/window frame, and the two swing supporting mechanisms 9100 and the two guiding structures 9200 form a linkage structure with an opening at the lower end via connection members 9700.

In the description of the specification, the description of reference terms "an implementation mode", "some implementation modes", "an embodiment", "some embodiments", "example", "specific examples", "some examples" or the like means a specific characteristic, structure, material or feature described in connection with the embodiment or example are included in at least one embodiment or example of the present disclosure. In the specification, the schematic representation of the above terms does not necessarily refer to the same embodiment or example. Moreover, the described specific characteristics, structures, materials or features may be combined properly in one or more embodiments or examples.

The foregoing description is merely a further detailed description of the present disclosure in connection with one or more specific embodiments. Thus, the specific implementations in accordance with the present disclosure will not be limited to the description set forth herein. Those of ordinary skill in the art to which the present disclosure pertains will be able to perform a number of simple deductions or substitutions without departing from the concept of the present disclosure.

What is claimed is:

1. A sliding door or window, comprising: a door/window frame; two swing supporting mechanisms, each arranged on a lower end of a respective side of the door/window frame; and two guiding structures, each mounted on an upper end of the respective side of the door/window frame;

wherein each swing supporting mechanism is provide with a first curved groove and each guiding structure is provided with a pair of second curved grooves, and a drive shaft operative to slide along an orientation of the first curved groove is arranged within the first curved groove;

wherein a handle disposed on the door/window frame is operative to drive the drive shaft to slide in the first curved groove, which forces at least one of the swing supporting mechanism or the guiding structure to swing;

wherein the swing supporting mechanism comprises: a base, configured to be fixedly connected to a door or window; and a pendulum member, having a lower end hinged on the base; wherein the first curved groove is provided on an upper end of the pendulum member, the drive shaft is arranged through the first curved groove and is slidable within the first curved groove, the drive shaft is connected to a sliding block which has an upper end drivingly connected to the handle of the door or window and which is operative to drive the drive shaft to slide in the first curved groove thereby forcing the pendulum member to swing around an axis of an articulated shaft, and a lower end of the pendulum member is connected to a roller configured to be mounted on a guide rail on a lower side of the door or window;

the guiding structure comprises a right-angled connection casing configured to be mounted on the door or window, a fixed base configured to be mounted on the door or window, a swing piece, a linkage piece, a first connection assembly, a second connection assembly, and at least one transmission belt;

the fixed base is provided with a first cavity body, one end of the swing piece is provided with a guide wheel configured to be mounted on the door or window and to be engaged with a guide rail on an upper side of the door/window frame, and the other end of the swing piece extends into the first cavity body of the fixed base and is hinged in the first cavity body; the second curved grooves are provided on the other end of the swing piece that extends into the first cavity body; a limit shaft movable along the second curved grooves are disposed within the second curved grooves; the linkage piece is connected to the limit shaft and is operative to move along the second curved grooves together with the limit shaft, and the moving process forces the swing piece to swing around the axis of the articulated shaft; and an end of the linkage piece facing away from the limit shaft is fixedly connected to the first connection assembly;

the right-angled connection casing is provided with a second cavity body; the transmission belt extends through the second cavity body of the right-angled connection casing, and two ends of the transmission belt are connected to the first connection assembly and the second connection assembly respectively thereby achieving a linkage of the transmission belt, the first connection assembly and the second connection assembly; and the two swing supporting mechanisms and the two guiding structures form a linkage structure with an opening at a lower end via a connection member.

2. The sliding door or window of claim 1, wherein the swing supporting mechanism further comprises a mounting bracket, the mounting bracket is provided with a cavity in which the pendulum member is inserted and is operative to swing to a certain extent; the mounting bracket is further provided with a pair of vertically extending grooves communicating with the cavity on opposite sides of the mounting bracket, two ends of the drive shaft are movably snap-fitted in the vertically extending grooves, respectively, a lower end of the sliding block is inserted into the cavity and connected to the drive shaft, and the lower end of the pendulum member extends outside of the cavity and is then connected to the roller; the pendulum member is provided with a first hinge hole, a lower end of the mounting bracket is provided with a second hinge hole, and a lower end of the base is provided with a third hinge hole, and the pendulum member, the mounting bracket and the base are connected via engagement of a rotating shaft and the three hinge holes; and wherein in the guiding structure, the swing piece comprises two identical swing plates and a square shaft disposed between the two swing plates; the two swing plates are fixedly connected to the square shaft to achieve a linkage of the two swing plates and the square shaft; the two swing plates and the square shaft are hinged within the first cavity body of the fixed base via a rotating shaft; one end of the square shaft extends outside of the two swing plates and is provided with the guide wheel configured to be mounted on the door or window; the second curved grooves are respectively defined in one end of the two swing plates facing away from the square shaft; and the linkage piece is further disposed between the two swing plates, and after the limit shaft extends through the linkage piece, two ends of the limit shaft are disposed in the second curved grooves of the two swing plates enabling the limit shaft move along the second curved grooves together with the linkage piece.

3. The sliding door or window of claim 2, wherein in the swing supporting mechanism, the lower end of the sliding block is provided with a U-shaped through groove, the upper end of the pendulum member is provided with a vertically extending lug operative to be inserted into the U-shaped through groove, the first curved groove is defined on the lug, and a portion of the mounting bracket corresponding to the lug is provided with a swing window configured for ensuring a sufficient swinging travel of the lug during a swinging process;

in the guiding structure, the first connection assembly comprises a first connection piece and a first transmission piece which are fixedly connected to the linkage piece; the second connection assembly comprises a second connection piece and a second transmission piece which are fixedly connected to each other; the first transmission piece and the second transmission piece are connected via the flexible transmission belt to achieve a linkage of the first transmission piece, the transmission belt, and the second transmission piece; one end of the right-angled connection casing is provided with a first sliding groove along which the first transmission piece is operative to move; and the other end of the right-angled connection casing is provided with a second sliding groove along which the second transmission piece is operative to move.

4. The sliding door or window of claim 1, wherein a mounting groove is defined at one side of the base adjacent to the pendulum member, and at least a portion of the mounting bracket is operative to be snap-fitted within the mounting groove.

5. The sliding door or window of claim 4, wherein a guide groove is defined at an upper end of one side of the base adjacent to the mounting bracket, the sliding block is provided with a guide portion configured to be snap-fitted with the guide groove, the mounting groove is located below the guide groove, and a limit structure for mate with the mounting bracket is arranged between the guide groove and the mounting groove.

6. The sliding door or window of claim 5, wherein the guide groove and the mounting groove are both rectangular grooves and have a consistent orientation, the guide groove has a width smaller than a width of the mounting groove, the limit structure is a limit platform protruding outward from the guide groove, the mounting bracket is in a quadrilateral cylindrical shape and has a side surface abutting against a bottom of the mounting groove so as to be fitted with the base, and one end of the mounting bracket abuts against a boss protruding outward from the guide groove.

7. The sliding door or window of claim 1, wherein the roller is mounted at the lower end of the pendulum member via a bracket.

8. The sliding door or window of claim 4, wherein within the mounting groove is provided a receiving groove, which has substantially the same length as the vertically extending grooves and is configured for one end of the drive shaft to slide in.

9. The sliding door or window of claim 1, wherein the sliding block is provided with a shock-absorbing muffling spacer; and a first shock-absorbing muffling spacer is disposed at one end of the first connection assembly facing away from the right-angled connection casing, and a second shock-absorbing muffling spacer is disposed at one end of the second connection assembly facing away from the right-angled connection casing.

10. The sliding door or window of claim 1, wherein the roller is a U-shaped groove wheel made of an elastic material, and the transmission belt is a flexible steel belt.

11. The sliding door or window of claim 2, wherein a mounting groove is defined at one side of the base adjacent to the pendulum member, and at least a portion of the mounting bracket is operative to be snap-fitted within the mounting groove.

12. The sliding door or window of claim 3, wherein a mounting groove is defined at one side of the base adjacent to the pendulum member, and at least a portion of the mounting bracket is operative to be snap-fitted within the mounting groove.

13. The sliding door or window of claim 2, wherein the roller is mounted at the lower end of the pendulum member via a bracket.

14. The sliding door or window of claim 3, wherein the roller is mounted at the lower end of the pendulum member via a bracket.

15. The sliding door or window of claim 2, wherein the sliding block is provided with a shock-absorbing muffling spacer; and a first shock-absorbing muffling spacer is disposed at one end of the first connection assembly facing away from the right-angled connection casing, and a second shock-absorbing muffling spacer is disposed at one end of the second connection assembly facing away from the right-angled connection casing.

16. The sliding door or window of claim 3, wherein the sliding block is provided with a shock-absorbing muffling spacer; and a first shock-absorbing muffling spacer is disposed at one end of the first connection assembly facing away from the right-angled connection casing, and a second shock-absorbing muffling spacer is disposed at one end of the second connection assembly facing away from the right-angled connection casing.

17. The sliding door or window of claim 5, wherein the sliding block is provided with a shock-absorbing muffling spacer; and a first shock-absorbing muffling spacer is disposed at one end of the first connection assembly facing away from the right-angled connection casing, and a second shock-absorbing muffling spacer is disposed at one end of the second connection assembly facing away from the right-angled connection casing.

18. The sliding door or window of claim 2, wherein the roller is a U-shaped groove wheel made of an elastic material, and the transmission belt is a flexible steel belt.

19. The sliding door or window of claim 3, wherein the roller is a U-shaped groove wheel made of an elastic material, and the transmission belt is a flexible steel belt.

* * * * *